United States Patent [19]

Knisley

[11] Patent Number: 4,512,422

[45] Date of Patent: Apr. 23, 1985

[54] APPARATUS FOR DRILLING OIL AND GAS WELLS AND A TORQUE ARRESTOR ASSOCIATED THEREWITH

[76] Inventor: Rondel Knisley, 15611 Superior St., Sepulveda, Calif. 91343

[21] Appl. No.: 507,966

[22] Filed: Jun. 28, 1983

[51] Int. Cl.[3] ..... E21B 4/18

[52] U.S. Cl. ..... 175/99; 175/61; 175/230; 175/325

[58] Field of Search ..... 175/50, 61, 230, 325, 175/99, 98, 97, 93, 94; 166/212, 217

[56] References Cited

U.S. PATENT DOCUMENTS

| | | | |
|---|---|---|---|
| 2,712,920 | 7/1955 | Cullen et al. | 175/99 |
| 3,002,564 | 10/1961 | Baker | 166/212 |
| 3,011,555 | 12/1961 | Clark, Jr. | 166/212 |
| 3,285,343 | 11/1966 | Urbanusky | 166/217 |
| 3,872,932 | 3/1975 | Gosselin | 175/103 |
| 4,418,770 | 12/1983 | Lambot | 166/217 |
| 4,431,068 | 2/1984 | Dellinger et al. | 175/94 |

FOREIGN PATENT DOCUMENTS

| | | | |
|---|---|---|---|
| 800685 | 1/1981 | U.S.S.R. | 175/50 |

*Primary Examiner*—Stephen J. Novosad
*Assistant Examiner*—Mark J. DelSignore

[57] ABSTRACT

An apparatus for drilling oil and gas wells includes an articulated drilling assembly having a bit which is powered by an air motor pressurized by air or gas delivered from the surface of the earth via a coiled tube. A torque arrestor is used to keep the drilling assembly from rotating with the bit. The apparatus is suitable for drilling horizontally within the earth as well as vertically.

3 Claims, 8 Drawing Figures

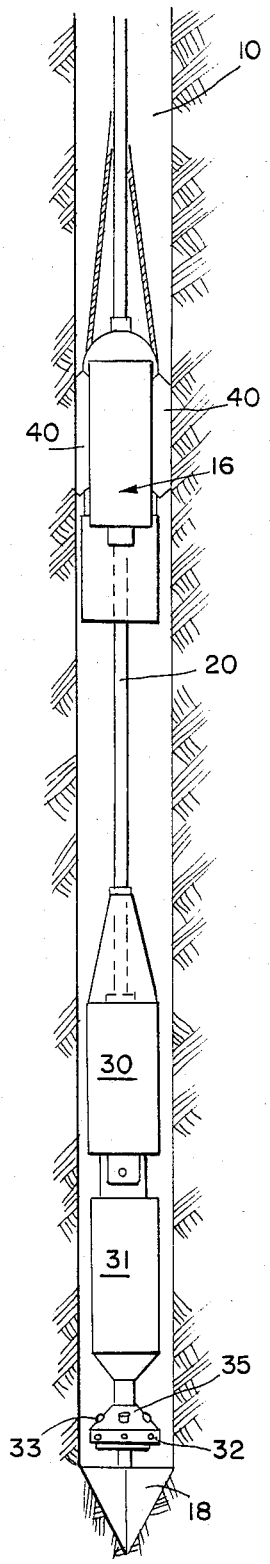
FIG. 2
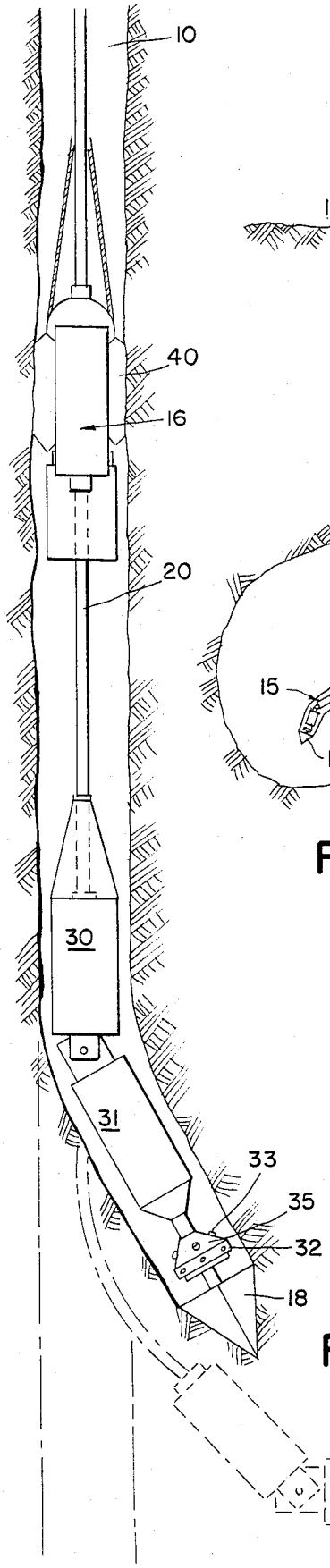
FIG. 3
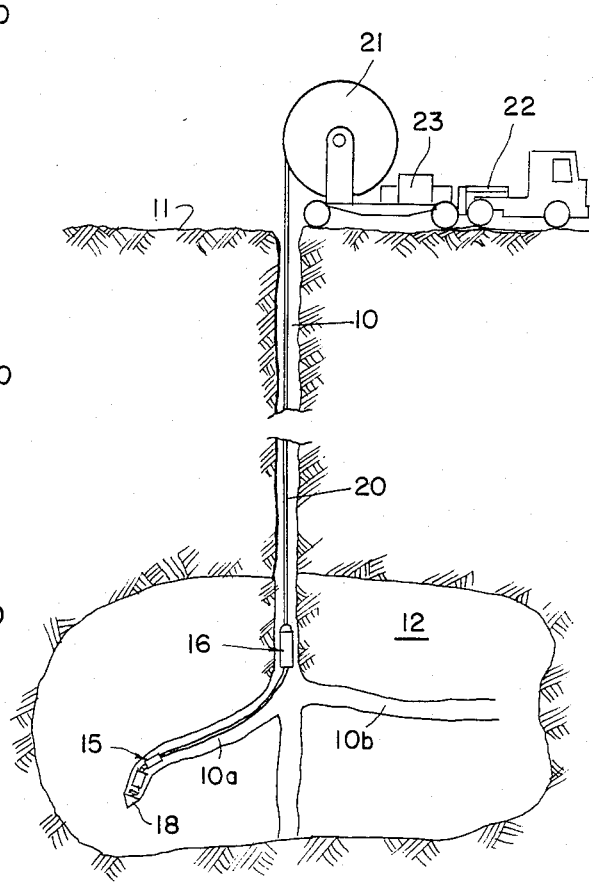
FIG. 1
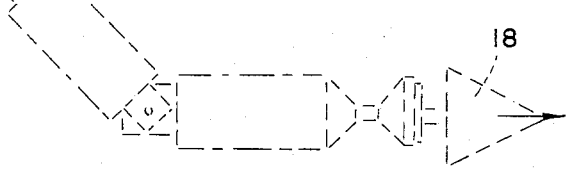

FIG. 7
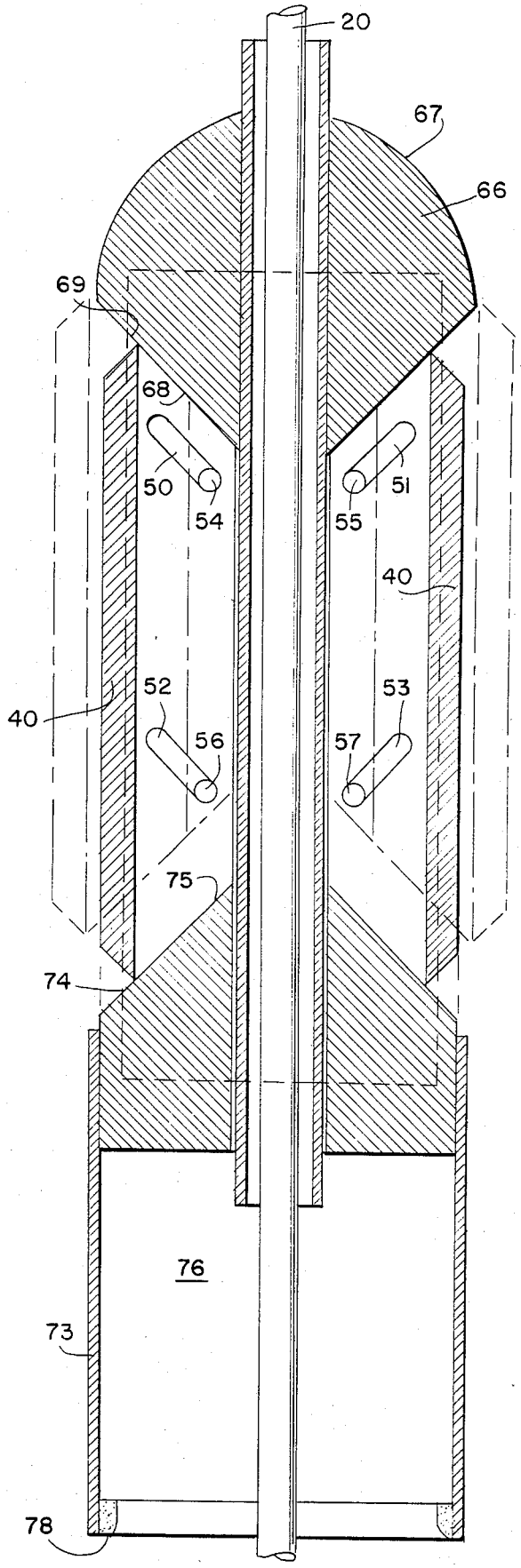
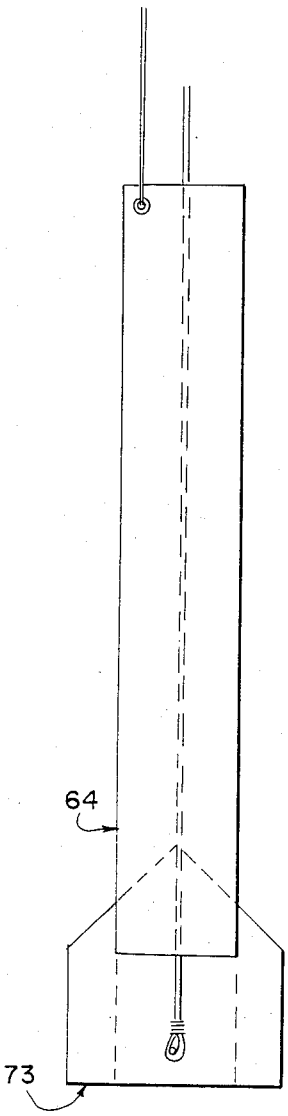
Pulling Device
FIG. 7A

APPARATUS FOR DRILLING OIL AND GAS WELLS AND A TORQUE ARRESTOR ASSOCIATED THEREWITH

BACKGROUND OF THE INVENTION

1. Field of the Invention

This invention relates to methods of and apparatus for drilling bores in the earth to tap deposits of materials such as petroleum and natural gas. More particularly, the instant invention relates to methods of and apparatus for inhole drilling, wherein a torque arrestor is utilized to prevent rotation of an inhole drill assembly so as to improve both vertical well-drilling techniques and horizontal boring techniques.

2. Prior Art and Technical Considerations

The usual method for drilling oil and gas wells is to attach a bit to a "string" of pipes and to rotate the pipes via a surface drive. The bits depend on the "string" weight and surface drive torque to produce a scraping or grinding action as it is rotated at the bottom of the bore hole. This requires considerable torque and generates enormous pressure on the drill bit. To change a bit, the "string" must be removed from the bore hole. This is an expensive, complex, time-consuming and dangerous procedure. The pipes are connected to the drill bit in sections to form the "string". This is an expensive, complex, unreliable and dangerous procedure. Frequently, the string is a couple of thousand feet long. During the drilling operation, pipe sections can break, which necessitates retrieving that portion of the string which extends from the surface down to the break and then reassembling the string.

In addition, by utilizing the aforedescribed drilling procedure, it is virtually impossible to drill in a horizontal direction. Consequently, oil and gas deposits which are distributed in horizontal strata (sometimes less than ten feet in thickness) can really only be punctured using the conventional approach. The "puncture" can be expanded by various methods; however, one cannot conveniently bore laterally of the initial vertical well hole to access directly lateral areas of the field. Consequently, in order to effectively pump out a field, numerous vertical wells, which are fairly close to one another, must be drilled.

One approach to solving this problem is to utilize an inhole drill assembly wherein the pipe string is not necessary, since the drill is powered by an air motor, or perhaps electric motor, which is proximate the bit. This method is not utilized because of the great difficulty in locking the air motor assembly against rotation as the drill bit cuts the bore. In view of the advantages of inhole drill assemblies, there is a need for a mechanism which will effectively prevent rotation of the motor assembly for an inhole drilling device.

SUMMARY OF THE INVENTION

In view of the afore-mentioned considerations, it is a feature of the instant invention to provide new and improved methods of and apparatus for drilling wells, such as oil and gas wells, wherein a new and improved torque arrestor is provided so as to facilitate utilization of inhole drilling assemblies which can drill horizontally as well as vertically.

In view of this feature, the instant invention contemplates a method for drilling with an inhole drill assembly wherein a drive motor utilized with the assembly is locked against rotation within the well hole, thereby permitting lateral drilling into juxtaposed oil and gas strata as well as vertical drilling. The method further contemplates taking temperature measurements while drilling in order to keep the bore being drilled in intersection with the strata containing the oil or gas.

In order to accomplish the aforedescribed method, the instant invention contemplates apparatus which includes a new and improved torque arrestor. The torque arrestor includes an internal tube through which a flexible tubing passes and which is fixed to a top shroud which has a cam surface thereon. A frame is positioned beneath the top shroud in sliding relationship with the internal tube and includes a guide which prevents the frame from rotating with respect to the top tube and a pair of spaced side plates. Gripping members, each having at least one longitudinally extending edge for penetrating the wall of the drill hole, are positioned between the side plates. The gripping members are normally retained between the plates in a retracted position. A bottom shroud is provided which is also slidable on the internal tube and has a camming surface which cooperates with camming surfaces on the gripping members. Upon moving the bottom shroud toward the top shroud, the camming surfaces engage the cooperating cam surfaces on the gripping members, forcing the gripping members laterally into locking engagement with the side wall of the well hole, so as to prevent the assembly from rotating with respect to the well hole. The downhole drilling assembly is secured to the torque arrestor so that the assembly does not rotate with the bit. This provides a platform or station for directional control when drilling horizontally and a torque arrestor for vertical drilling. The resulting drilling device is lightweight and runs at a higher RPM. The bit, which is diamond or cubic boron nitride-plated, produces a cutting or shearing action. It is used on the end of coiled tubing which can be injected and removed at the rate of 6,000 feet per hour.

BRIEF DESCRIPTION OF THE DRAWINGS

FIG. 1 is a schematic illustration, not to scale, showing a well-drilling apparatus in accordance with the instant invention drilling horizontally in a strata containing oil or gas.

FIG. 2 is a side view showing the well drilling apparatus of the instant invention in a vertical bore hole.

FIG. 3 is a side view showing the well drilling apparatus of the instant invention curving the bore hole to extend with a horizontal component.

FIG. 7 is a side elevation showing the locking member with gripping plates shown in solid lines when in the retracted position and in dotted lines when in the extended condition, and FIG. 7A is a side view of the bottom shroud which cooperates with the camming surfaces on the gripping members.

DESCRIPTION OF THE PREFERRED EMBODIMENT

Figure 6:
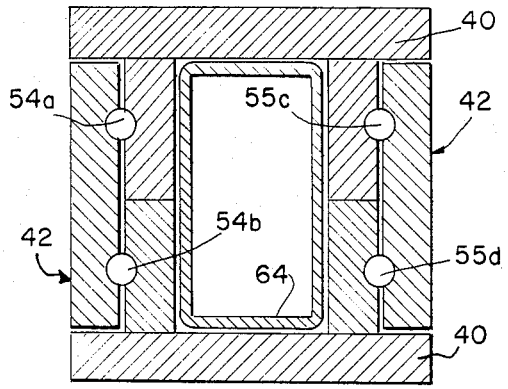
FIG. 6 is a top view of the locking member.

Referring now to FIG. 1, there is shown apparatus according to the instant invention wherein a vertical bore hole 10 is drilled from the earth's surface 11 through to an oil or gas-containing strata 12. By utilizing a downhole drilling assembly, designated generally by the numeral 15, in combination with a torque arrestor, designated generally by the numeral 16, the downhole drill assembly is prevented from rotating as the bit 18 of the drill assembly bores. Preferably, the bit 18 has a "cubic boron nitride" coating or is a diamond bit. Power for the bit assembly is supplied by a coiled tubing 20, which tubing is preferably stored on a reel 21 mounted on a truck 22. The truck 22 preferably includes a portable air compressor 23 which provides compressed air to the coiled tubing 20. In order to reduce the danger of fire, compressed nitrogen may be used to power the bit rather than compressed air.

As is seen in FIG. 1, the oil or gas-containing strata 12 extends generally in a horizontal direction. In order to effectively reach other areas of the strata and to do more than merely puncture the strata, the bore 10 can be branched laterally along paths 10*a* and 10*b*. By drilling laterally, one does not need to resort to additional vertical wells in close proximity to the well 10. Moreover, when drilling through porous rock, a greater surface area of the bore is exposed to the oil or gas-bearing strata. While horizontal drilling has considerable advantages under some circumstances, it should be kept in mind that the instant invention is also of great significance in that it allows utilization of inhole drilling assemblies for vertical wells.

Figure 4:
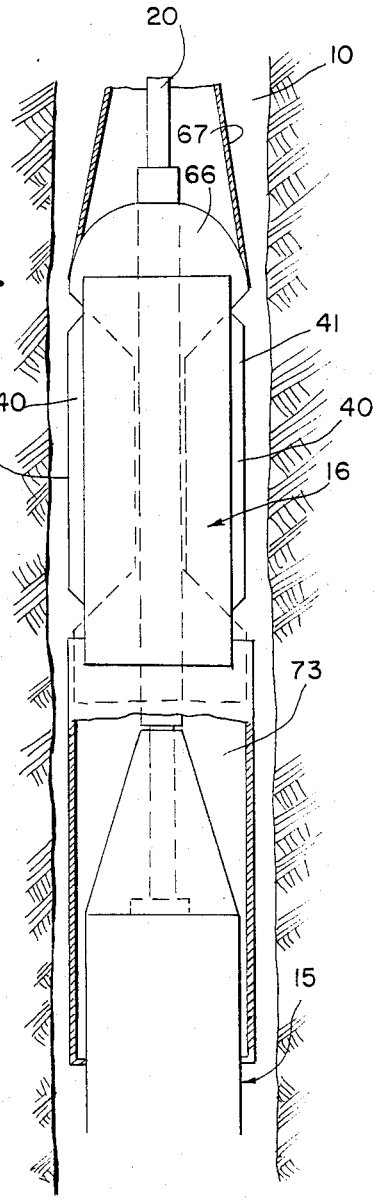
FIG. 4 is a side view showing a locking member in an unlocked condition.
Figure 5:
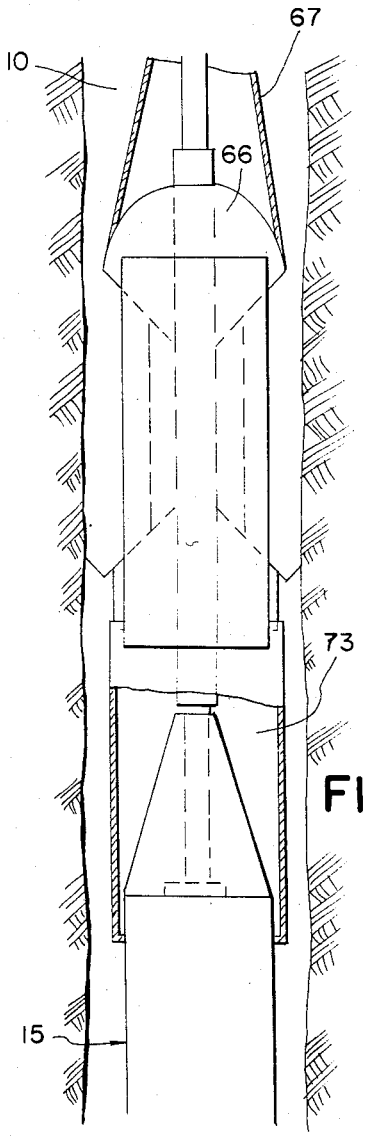
FIG. 5 is a side view showing the locking member in a locked condition.

Referring now to FIGS. 2 through 7, the inhole drilling assembly 15 is shown in combination with the torque arrestor 16. The inhole drilling assembly 15, and air motor 31 and the bit 18. The air motor 31 is connected to the control section 30 by a 180° joint 32. The coil tubing 20 passes through the torque arrestor 16 and downhole drill assembly 15 to deliver compressed air to the air motor housing 31. As the compressed air exhausts from the air motor housing 31, it, in effect, blows cuttings made by the bit 18 back past the torque arrestor 16 and out of the bore hole 10.

If the drilling assembly 15 is to be used as a device which automatically seeks oil or gas, then the assembly may include a sensing head 35 with temperature or gas sensors 33 and thrusters 32 thereon. The temperature sensors 32 determine the direction that the bores 10*a* or 10*b* should take by sensing the low temperature areas or gaseous areas while the thrusters keep the bit 18 drilling in the center of the pay zone 12. The bit 18 may be initially urged in a direction lateral of the bore hole 10 to drill the horizontal bores 10*a* and 10*b* by activating an air cylinder located in air motor housing 31.

The torque arrestor 16 functions by projecting a pair of gripping members 40 laterally against the wall of bore hole 10. Each gripping plate has a pair of longitudinally extending edges 41 which penetrate slightly into the wall 10 to prevent rotation of the torque arrestor within the bore. As is seen in FIGS. 4–7, the gripping plates 40 are mounted between a pair of rectangular side plates 42.

In order to facilitate easy movement of the gripping plates 40, the gripping plates 40 have pairs of slanted grooves 50, 51, 52 and 53 formed therein which cooperate with similar grooves on the side plates 42. Bearings 54, 55, 56 and 57 are contained within the grooves in order to keep friction between the gripping members 40 and side plates 42 to a minimum as the gripping members move between their retracted and projected positions. An upper shroud 66 fits over the upper end of the torque arrestor 16. The upper shroud has a curved upper surface 67 and a bottom surface defined by a pair of cams 68—68. The cams 68—68 compliment camming surfaces 69—69 on the side flanges of the U-shaped gripping members 40. Preferably, the upper shroud 67 is fixed to the tube 64 so as to be fixed with respect to the frame formed by side plates 42.

A lower shroud 73 is configured to slide on the square tube 64 so that it may move toward and away from the upper shroud 66. The lower shroud 73 has upper cam surfaces 74—74 which compliment lower cam surfaces 75—75 on the grippig members 40. The lower shroud 73 includes a chamber 76 through which compressed air from line 20 enters so as to force the lower shroud 73 upward. When the lower shroud 73 is forced upward, the cam surfaces 74 thereon engage the cam surfaces 75 on the gripping members 40 and urge the gripping members 40 outwardly. Since the gripping members 40 also have cam surfaces 69 thereon, which are in engagement with the fixed cam surfaces 68 on the upper shroud 67, the gripping members move outwardly in a direction normal to the longitudinal extent of the torque arrestor 16 so that the gripping edges 41 are substantially parallel to the longitudinal axis of the torque arrestor 16. This helps prevent the torque arrestor 16 from becoming skewed within the well hole 10.

When section 30 is pulled upwardly with enough force to overcome the weight of tube 64 and shroud 66, shroud 66 moves upwardly and the automatic retraction of the gripping members 40 occurs in part because the gripping members are mounted with slanting grooves 50–53 which slant downwardly and join the gripping members 40 to the side plates 42 with the rolling bearings 54.

The bottom surface 78 of the lower shroud 73 is rounded so that cuttings from the bore hole 10 will easily flow past the lower shroud. The side plates 42 form a housing which keeps the cuttings or other material from jamming the grooves which connect the gripping members 40 to the interior of the side plates 42.

Anytime the lower end of square tube 64 is in contact with the upper end of assembly 15, it activates a valve inside section 30 by means of a plunger or magnetic switch also inside section 30. The arrangement is such that 100 psi causes air motor housing 31 to pivot to the left. When 100 psi is applied, and the pressure is still maintained at 100 psi after a time delay, pressure is applied to the air cylinder causing the piston therein to extend and force air motor housing 31 to the right. After assembly 15 is away from square tube 64, an increase in pressure has no effect in making it move to the left. After the horizontal hole has been drilled to the right and assembly 15 is pulled back into contact with square tube 64, and 250 psi is applied and maintained for a time period, the piston retracts and forces air motor housing 31 to the left. If the device is in an oil zone and one wants more than two holes, then the housing of section 30 will pivot 45° and drill two more holes. If one drills 100 feet in each hole and section 30 pivots around 45° each three times, this will produce 800 feet of oil zone.

What is claimed is:

1. A torque arrestor for use in a well hole to prevent rotation of a drilling apparatus associated with a rotating bit which is powered by pressurized gas delivered through a coiled tube, the torque arrestor comprising:

a pair of spaced side plates having first and second ends and being joined at the first and second ends to form a supporting frame;

a tube extending between the plates and being secured in non-rotating relationship therewith through which the coiled tube passes;

a first cam fixed to the supporting frame adjacent to the first ends of the plates;

a second cam slidably mounted on the frame adjacent to the second ends of the plates;

means for moving the cams toward one another;

a pair of gripping members each having at least two gripping edges, the gripping members being mounted between the plates and having first and second follower surfaces thereon aligned with the first and second cam surfaces, whereby when the cam surfaces move toward one another, the gripping members are urged laterally into engagement with the wall of the bore hole, and the torque arrestor wherein the gripping members are secured between the plates by links and wherein friction between the plates and gripping members is reduced by disposing bearings between the gripping members and plates and retaining the bearings in slots.

2. The torque arrestor of claim 1 wherein the drill is rotated by gas pressure delivered through the coiled tube and wherein the means for moving the cams toward one another includes a chamber which is pressurized by gases used to rotate the drill.

3. The torque arrestor of claim 1 further including shrouds covering the opposite ends of the arrestor, the shrouds having converging ends whereby material in the bore can flow easily past the arrestor.

* * * * *